US006338176B1

(12) United States Patent
Smith et al.

(10) Patent No.: US 6,338,176 B1
(45) Date of Patent: Jan. 15, 2002

(54) MANUAL ROTARY BRUSH

(76) Inventors: Lee Y. Smith; Paul A. Smith, both of 2311 Mohawk La., Glenview, IL (US) 60025

( * ) Notice: Subject to any disclaimer, the term of this patent is extended or adjusted under 35 U.S.C. 154(b) by 0 days.

(21) Appl. No.: 09/351,938

(22) Filed: Jul. 12, 1999

Related U.S. Application Data

(63) Continuation-in-part of application No. 09/039,513, filed on Mar. 16, 1998, now Pat. No. 5,996,157.

(51) Int. Cl.[7] ..... A46B 13/08; A46B 9/04

(52) U.S. Cl. ..... 15/28; 15/22.1; 15/167.1; 15/DIG. 5

(58) Field of Search ..... 15/28, 22.1, 167.1, 15/DIG. 5, 201

(56) References Cited

U.S. PATENT DOCUMENTS

| | | | | |
|---|---|---|---|---|
| 1,090,126 A | | 3/1914 | Reichmann | |
| 1,424,879 A | * | 8/1922 | Carlstedt | 15/28 |
| 1,557,244 A | | 10/1925 | Dominque | |
| 1,620,330 A | | 3/1927 | Douglass | |
| 4,739,532 A | | 4/1988 | Behrend | |
| 5,142,724 A | | 9/1992 | Park | |
| 5,276,932 A | | 1/1994 | Byrd | |
| 5,416,942 A | * | 5/1995 | Baldacci et al. | 15/22.1 |
| 5,524,319 A | | 6/1996 | Avidor | |
| 5,996,157 A | * | 12/1999 | Smith et al. | 15/28 |
| 6,023,313 A | * | 12/1999 | Tsang | 15/28 |
| 6,021,538 A | * | 2/2000 | Kressner et al. | 15/28 |

FOREIGN PATENT DOCUMENTS

| | | |
|---|---|---|
| FR | 2622089 | 4/1989 |

* cited by examiner

*Primary Examiner*—Robert J. Warden, Sr.
*Assistant Examiner*—Kaj K. Olsen

(57) ABSTRACT

A hand-held rotary brush is provided with a handle, a brush head having a hollow space, a tuft of bristles mounted onto a rotary device which is loosely set within the hollow space of the brush head. When the user manually pushes the brush, a frictional force is created which propels the bristles to catch the irregular surface of the teeth, gaps, causing the rotary device to turn to a circular rotating motion. The construction of the rotary brush can be improved by configured the rotary device with tracks and grooves, which sets within matched grooves and tracks of the hollow space to create a rotating path, that allows the rotary device to rotate within the hollow space of the brush head.

11 Claims, 3 Drawing Sheets

MANUAL ROTARY BRUSH

This application is a continuation-in-part of copending U.S. patent application Ser. No. 09/039,513 filed Mar. 16, 1998 now U.S. Pat. No. 5,996,157.

BACKGROUND OF THE INVENTION

The present invention generally relates to a toothbrush with multiple levels of bristles affixed perpendicular on a rotary pad. When a user manually operates the toothbrush with forward and backward brush movement, that converts the bristles forward and backward motion into circular motion. More specifically, the present invention relates to a toothbrush with varying lengths and positioned bristles permanently affixed perpendicular on a rounded pad, which rotates when the handle of the brush is pushed either to the right or left manually.

It is generally accepted in dental health care maintenance that circular brushing motion around and along the irregular contours of tooth surfaces is the preferred and correct method of brushing teeth and stimulating gums. The circular brushing motion is the best way to clean the gaps and pockets between teeth. It is also generally known that most people find it difficult to brush their teeth in a sustained circular movement manually, because of the physical effort in maintaining the circular movement for an extended length of time. There are electric toothbrushes that accomplish, to some extent, this desired result; however, they are costly to the consumer and require the use of electricity or batteries.

A need, therefore, exists for an improved inexpensive toothbrush that converts bristles from forward and backward brushing motion into a desirable system of circular brushing motion manually to clean and stimulate both teeth and gums in the more dental prescribed manner.

SUMMARY OF THE INVENTION

The present invention provides a toothbrush with multiple levels of bristles on a rotary pad. A stepped pattern of bristles is created to brush any and all irregularities, gaps, pockets and contours in the natural tooth formation and construction. It is the combination of the movement of brushing, and the multiple levels of bristles, that catch the surface of irregular teeth, gaps, and pockets which propel the bristles to rotate effectively along the teeth and gum line. When a user operates with left and right brushing movement, there is a force created which propels the bristles to catch the irregular surfaces of the teeth, causing the rotary pad to turn. When the user pushes the brush to the left, the rotary pad turns counterclockwise. When the user pushes the brush to the right, the rotary pad turns clockwise. The rotary pad can be turned at any desired circular position depending on whether the user normally brushes softer or harder in force. The pattern design and length of bristles can be varied and the construction of the rotary pad and the brush head can also be varied. It can be constructed by pose, axis, track, groove, and the like, or just a rotary device loosely set within its matched configuation case with overhang. Or, a rotary device can be comprised of several sets of individual and independent, circular rotating rings as long as the result can be accomplished and improved to provide the most effective manually operated rotary brushing method.

In an advantageous further improvement of the present invention, A rotary brush having a hollow space within the brush head and a rotary device is loosely set within the hollow space, a tuft of bristles mounted onto the rotary device, wherein an outer circle of the rotary device is configured a plurality of grooves forming a plurality of tracks and an inner circular wall of the hollow space is configured a plurality of tracks forming a plurality of grooves, wherein configurations of the tracks of the outer circle of the rotary device are constructed to match with configurations of the grooves of the inner circular wall of the hollow space and configurations of the grooves of the outer circle of the rotary device are constructed to match with configurations of the tracks of the inner circular wall of the hollow space, wherein the tracks of the rotary device are set within the matched grooves of the hollow space and the grooves of the rotary device are set within the matched tracks of the hollow space, by utilizes such arrangement which creating a circular rotating path to allow the rotary device to rotate within the hollow space. According to another improvement of the rotary device, the outer circle of the rotary device is constructed with a convex form and the inner circular wall of the hollow space is constructed with a concave form wherein the convex form of the outer circle of the rotary device is configured to match the concave form of the inner circular wall of the hollow space, wherein the convex form of the rotary device is loosely set within the matched concave form of the hollow space. By constructing in such ways, accordingly, while the track form is set with matched groove form or the convex form is set with matched concave form, and the like, are configured to fit in with each other, characteristically creating a unrestricted circular rotating path and retaining condition in between, therefore allows the rotary device to rotate and retain within the hollow space, upon moving the brush handle, a frictional force is created which propels the bristles to turn to a circular rotation. Another further development of the present invention, the rotary device can be comprised of two or three sets of circularly rotating rings with their own tufts of bristles, each of the rings individually and independently capable of acting on their own, and operate substantially similar to the previously described single ringed rotary device, which utilizing means for matching configurations between each of the rings also between the outer circle of the rotary device and the inner circular wall of the hollow space. The rings' bristles individually and independently rotate as a result of a user manually pushing the brush in a side-to-side fashion. The bristles of each of the rings catch different gaps and points of the teeth which create different forces of circular rotation with more effective results. According to further feature of the present invention, an arched overhang is formed around top edge of the hollow space which provides a retaining configuration, such overhang is a extra secure feature to retain the rotary device within the brush head. The present invention's objects and advantages: The present invention omitted integral elements of the prior art without loss of capability which still creates a manual rotary brush effectively. The toothbrush can be comprised of two or even three rotary pads for an adult size toothbrush, or only one rotary pad for a child's size toothbrush.

Additional features and advantages of the present invention are described in, and will be apparent from, the detailed description of the presently preferred embodiments and from the drawings. While my above description contains many specificities these should not be construed as limitations on the scope of the invention, but rather as an exemplification of one preferred embodiment thereof. Many other variations are possible. Accordingly, the scope of the invention should be determined not by the embodiment illustrated, but by the appended claims and their legal equivalents.

DETAILED DESCRIPTION OF THE PRESENTLY PREFERRED EMBODIMENTS

Figure 1:
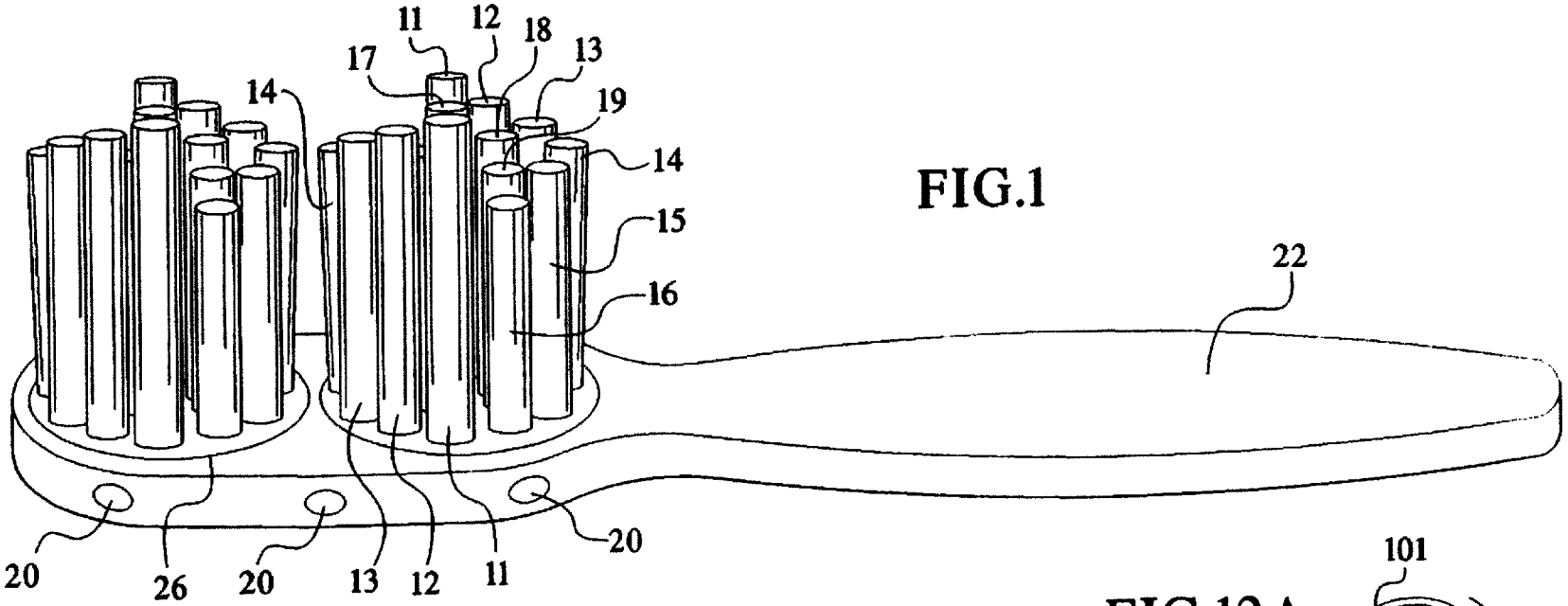
FIG. 1 illustrates a perspective view of a toothbrush with two rotary pads with varying length bristles, and water release holes.

Referring to FIG. 1, a hand-held toothbrush comprising a handle 22 and two rotary pads 26 with two stepped pattern bristle configurations is shown. Bristle 11 represents the highest level graduated to bristles 16, which represent the lowest level. The differences in length between the bristles 11–16 in graduated outer pattern 11, 12, 13, 14, 15,16 is 0.04 inch. Bristles 17, 18 and 19 which represents an inner pattern is shorter in measurement. The difference in length in a graduated inner pattern between bristles 17,18,19 is 0.04 inch. Water release hole 20 is to release water and toothpaste residue. Hole 20 facilitates clean out. Rotary pad 26 rotates easily upon manual pushing movement from either right to left or left to right. Rotary motion covers a complete 360 degrees or can be rotated at any circular position.

Figure 2A:
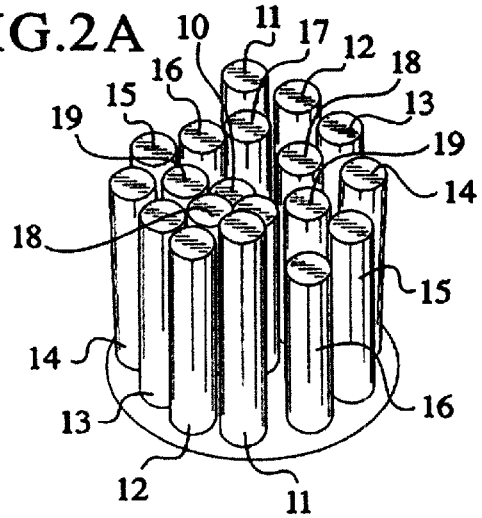
FIGS. 2A and 2B illustrate perspective views of the same bristle pattern wherein the pattern is two combined sets of equally graduated bristle stepped patterns.
Figure 2B:
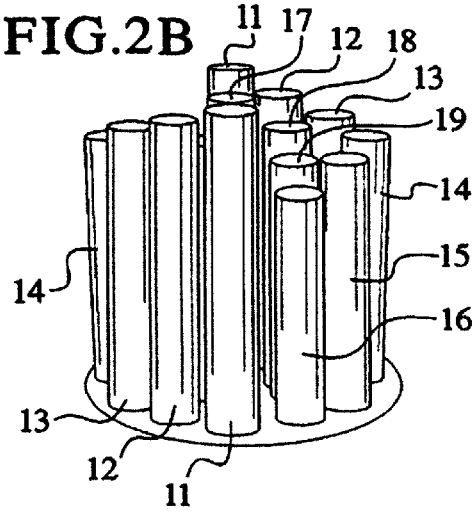

Referring to FIGS. 2A and 2B, the bristle pattern is exactly the same configuration, except graphically displayed from different angle position.

The bristle pattern is designed to specially improve the rotation more effectively. It can be described as follows: center bristle 10 has a length of 0.32 inch. Inner circle consists of two sets of bristles 17,18 and 19. Bristle 17 has a length of 0.44 inch. Bristle 18 has a length of 0.4 inch. Bristle 19 has a length of 0.36 inch, and the difference in length between each bristle 17 to 19 is 0.04 inch. Outer circle consists of two sets of bristles 11, 12, 13, 14 15, and 16. Bristle 11 has a length of 0.5 inch. Bristle 12 has a length of 0.46 inch. Bristle 13 has a length of 0.42 inch. Bristle 14 has a length of 0.38 inch. Bristle 15 has a length of 0.34 inch. Bristle 16 has a length of 0.3 inch and the difference in length between each bristle 11 to 16 is 0.04 inch. Measurement can be adjusted respectively as long as bristles remain consistent with the aforementioned pattern.

Figure 3A:
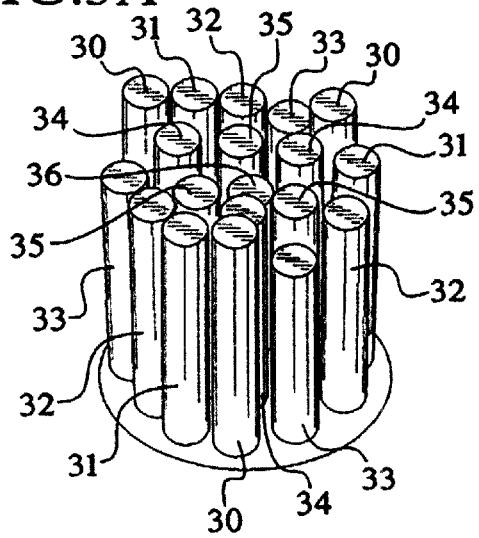
FIGS. 3A and 3B illustrate perspective views of two different angles of the same bristle pattern wherein the pattern is three combined sets of equally graduated bristle stepped patterns.
Figure 3B:
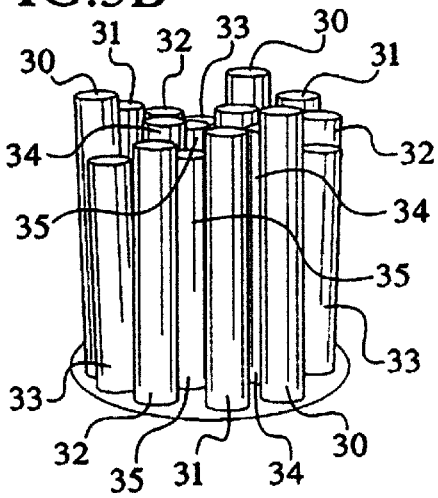

FIGS. 3A and 3B generally illustrate a bristle pattern with exactly the same configuration, except graphically displayed from different angle positions. The bristle pattern is designed to specially improve the rotation more effectively. It can be described as follows: center bristle 36 has a length of 0.34 inch, inner circle consists of three sets of bristles 34 and 35. Bristle 34 has a length of 0.42 inch, and bristle 35 has a length of 0.38 inch. Outer circle consists of three sets of bristles 30,31,32 and 33. Bristle 30 has a length of 0.48 inch, bristle 31 has a length of 0.44 inch, bristle 32 has a length of 0.4 inch, and bristle 33 has a length of 0.36 inch. Measurement can be adjusted respectively as long as bristles remain consistent with the aforementioned pattern.

Figure 4A:
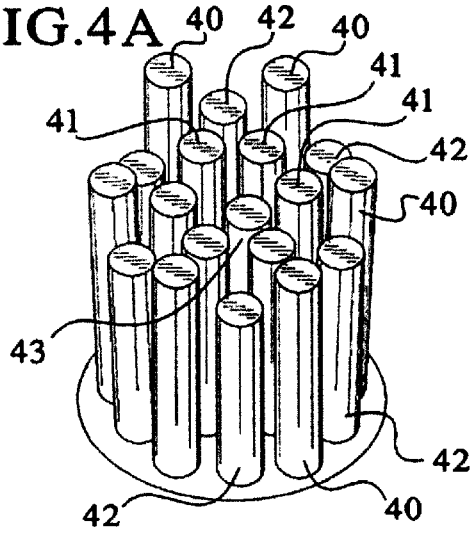
FIGS. 4A and 4B illustrate perspective views of two different angles of bristle patterns wherein the bristles are in an alternating pattern.
Figure 4B:
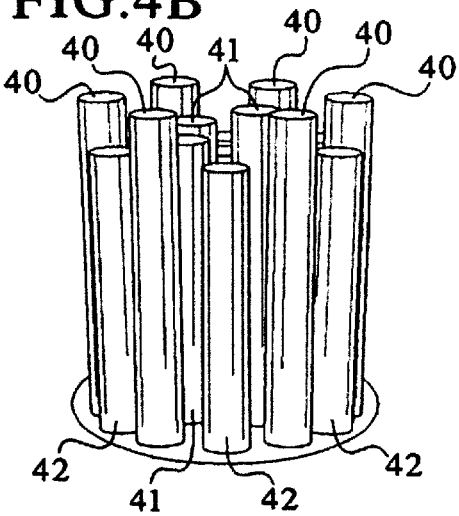

As shown in FIGS. 4A and 4B, bristle patterns have exactly the same configuration, except graphically displayed from different angle position. The bristle pattern is designed to specially improve the rotation more effectively. It can be described as follows: the center bristle 43 has a length of 0.4 inch, the inner circle consists of six bristles 41, and each bristle 41 has the same length of 0.44 inch. Outer circle consists of six bristles 40 and six bristles 42. Each bristle 40 length has a length of 0.48 inch, each bristle 42 has a length of 0.4 inch. Bristle 40 and bristle 42 are arranged in an alternating pattern. Measurement can be adjusted respectively as long as bristles remain consistent with the aforementioned pattern.

Figure 5:
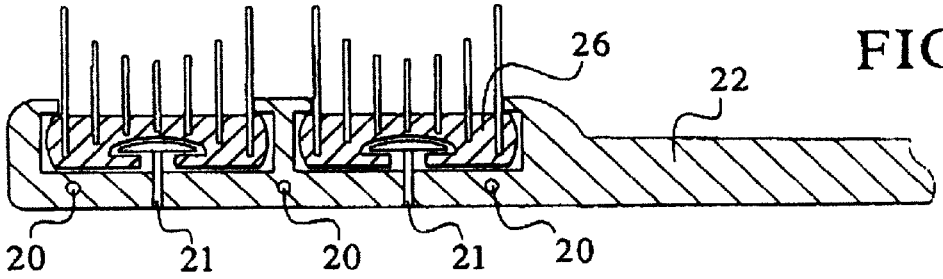
FIG. 5 illustrates a hand-held toothbrush with handle and two flat surface rotary pads and water release holes with two rounded post axes with crown tops.

Referring now to FIG. 5, a hand-held toothbrush comprises a handle 22 and a brush head with a rotary pad 26 with a flat surface and multiple levels of bristles, placed on a rounded post axis 21 to allow rotary pad 26 to freely turn. A water release hole 20 on both sides of the brush is created to facilitate cleaning the toothbrush and to release excess water.

Figure 6:
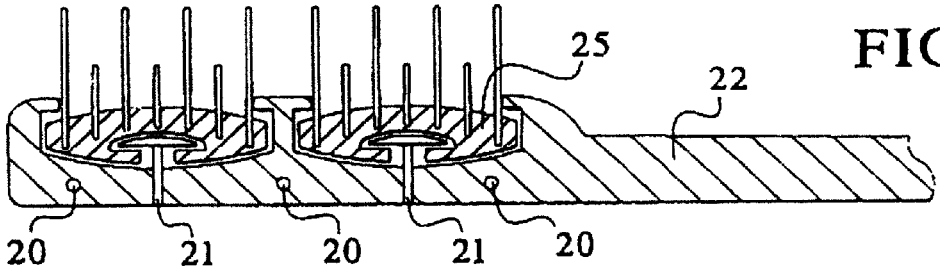
FIG. 6 illustrates a hand-held toothbrush with handle and two convex surface rotary pads and water release holes with two rounded post axes with crown tops.

As shown in FIG. 6, a hand-held toothbrush comprises a handle 22 and a brush head with rotary pads with a slightly convex top and bottom with multiple levels of bristles. Placed on rounded post axis 21, the slightly convex shape of the rotary pad is designed to more effectively cause the rotary pad to freely turn. A water release hole 20 on both sides of the brush is created to facilitate cleaning the toothbrush and to release excess water.

Figure 7:
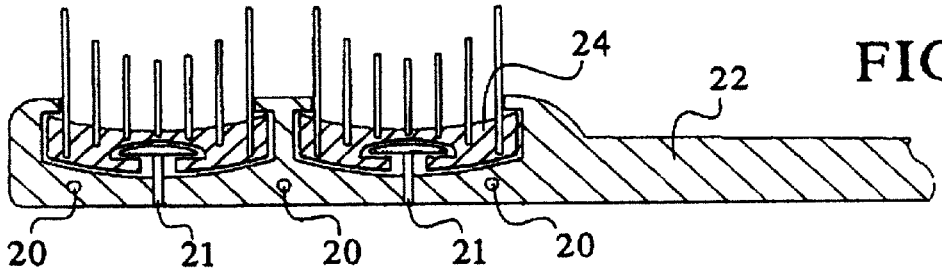
FIG. 7 illustrates a hand-held toothbrush comprising a handle and two concave rotary pads and water release holes with two rounded post axes with crown tops.

Referring to FIG. 7, a hand-held toothbrush comprises a handle 22 and a brush head with rotary pads 24 with a slightly concave top and bottom with multiple levels of bristles. Placed on a rounded post axis 21, the slightly concave shape of the rotary pad is designed to more effectively cause the rotary pad to freely turn. A water release hole 20 on both sides of the brush is created to facilitate cleaning the toothbrush and release excess water.

Figure 8:
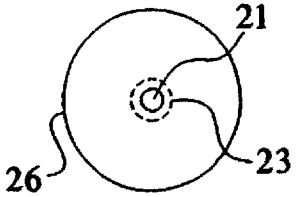
FIG. 8 illustrates a rotary pad and rounded post axis with a crown top.

FIG. 8 illustrates an axis 21 with a wider diameter crown 23, which secures rotary pad 26 in place, and allows the rotary pad to turn freely.

Figure 9:
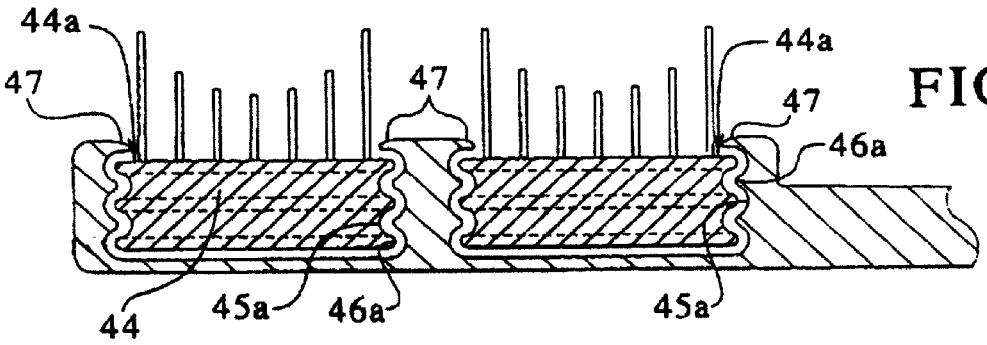
FIG. 9 illustrates a side view of rotary pads within a brush head in an embodiment of the present invention.

FIG. 9 generally illustrates another embodiment of a toothbrush with a head having rotary pads 44 configured within two grooves 45*a* forming three tracks 46*a* on an outer circle 44*a* of the rotary pads 44. The outer circle 44*a* of the rotary pad 44 rotate within the tracks 46*a* defined by the grooves 45*a* of an inner circular wall of a hollow space of the toothbrush. The grooves 45*a* of the rotary pad 44 fits in with the tracks 46*a* of the hollow space and the tracks 46*a* of the rotary pad 44 fits in with the grooves 45*a* of the hollow space. Preferably, the grooves 45*a* and the tracks 46*a* both have smooth rounded corners, also a bottom base of the rotary pad and an inner foundation of the hollow space of the brush head both having a flat configuration to match with each other. An arched overhang 47 is formed around top edge of the hollow space of the toothbrush head such that the rotary pad 44 is retained in position. The rotary pads 44 are loosely set within the toothbrush head and allows for substantially unrestricted mobility thereof.

Figure 10:
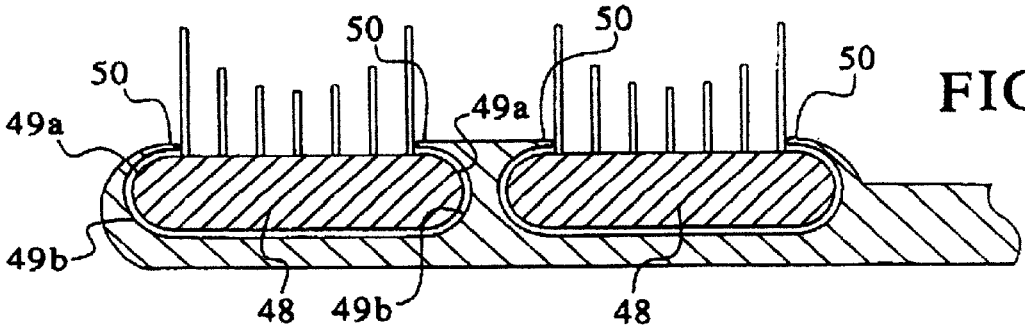
FIG. 10 illustrates another side view of an embodiment of rotary pads within a brush head of the present invention.

Another embodiment of rotary pads 48 is generally shown in FIG. 10. The rotary pads 48 have a flat top and bottom with a convex form exterior circle 49*a*. The head of the brush has two rotary pads 48 built therein. A hollow space has a concave form 49*b* fits in with its matched convex form exterior circle 49*a* of the rotary pad 48, also a bottom base of the rotary pad and an inner foundation of the hollow space of the brush head both having a flat configuration to match with each other. The head has an arched overhang 50 around top edge of the hollow space to substantially retain the rotary pad 48 in position such that the rotary pad 48 is loosely set within the head and allows for substantially unrestricted mobility of the rotary pad 48 therein.

Figure 11:
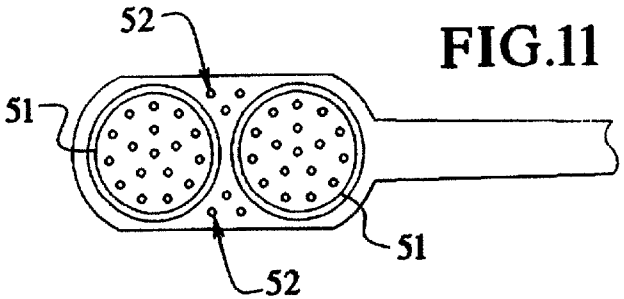
FIG. 11 illustrates a top view of an embodiment of a toothbrush having rotary pads.

FIG. 11 illustrates a toothbrush having two rotary pads 51 each having a tuft 52 of bristles between the spaces of the rotary pads 51. The tufts 52 of bristles do not rotate but are implemented to fully use the space on the brush head of the toothbrush, particularly the space between the rotary pads 51.

Figure 12A:
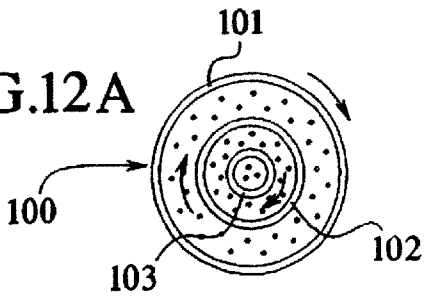
FIGS. 12A and 12B illustrate top views of rotary pads having rings with their own tufts of different lengths of bristles.
Figure 12B:
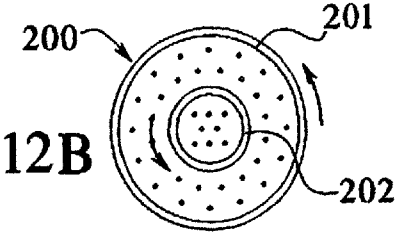

FIGS. 12A and 12B illustrate rotary pads having two or three sets of circularly rotating rings with their own tufts of different lengths of bristles on each ring individually and independently capable of acting on their own. A rotary pad 100 is generally shown in FIG. 12A having three sets of circular rotating rings 101, 102, and 103. FIG. 12B illustrates a rotary pad 200 having two sets of rings 201 and 202. The rotary pads with their independently operating rings of FIGS. 12A and 12B operate substantially similar to the previously described single ringed rotary pads of the previous figures. The rings' bristles individually and independently rotate as a result of a user manually pushing the toothbrush in a side-to-side fashion. The bristles of each of the rings catch different gaps and points of the teeth which create different forces of circular rotation with more effective results.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A manual rotary brush comprising:

a handle, a brush head having a hollow space, a tuft of bristles mounted onto a rotary device, the rotary device is set within the hollow space of the brush head with the handle orientation forming a rotary bush;

the rotary device comprising an outer circle configured with a plurality of tracks and grooves;

the hollow space comprising an inner circular wall configured with a plurality of tracks and grooves;

wherein the tracks of the outer circle of the rotary device are configured to match the grooves of the inner circular wall of the hollow space and the grooves of the outer circle of the rotary device are configured to match the tracks of the inner circular wall of the hollow space, and the tracks of the rotary device are set within the matched grooves of the hollow space and the grooves of the rotary device are set within the matched tracks of the hollow space, therefore allowing the rotary device to rotate within the hollow space thereby creating a circular rotation of the tuft of the bristles upon moving the brush handle.

2. The manual rotary brush according to claim 1 wherein the tracks and grooves of the rotary device and the hollow space all having smooth rounded corners.

3. The manual rotary brush according to claim 1, further including the rotary device having a plurality of circular rotating rings that each of the rings is rotated independently from other rings.

4. The manual rotary brush according to claim 1, further including an arched overhang is formed around top edge of the hollow space of the brush head.

5. A manual rotary brush comprising:

a handle, a brush head having a hollow space, a tuft of bristles mounted onto a rotary device, the rotary device is set within the hollow space of the brush head with the handle orientation forming a rotary brush;

the rotary device comprising an outer circle having a convex form;

the hollow space comprising an inner circular wall having a concave form; and wherein the convex form of the outer circle of the rotary device is constructed to match the concave form of the inner circular wall of the hollow space, and the convex form of the rotary device is set within the concave form of the hollow space, therefore allowing the rotary device to rotate within the hollow space thereby creating a circular rotation of the tuft of the bristles upon moving the brush handle.

6. The manual rotary brush according to claim 5, further including the rotary device having a plurality of circular rotating rings that each of the rings is rotated independently from other rings.

7. The manual rotary brush according to claim 5, further including an arched overhang is formed around top edge of the hollow space of the brush head.

8. A manual rotary brush comprising:

a handle, a brish head having a hollow space, the hollow space having a top edge, a tuft of bristles mounted onto a rotary device, the rotary device is set within the hollow space of the brush head with the handle orientation forming a rotary brush;

the rotary device comprising an outer circle;

the hollow space comprising an inner circular wall;

wherein the outer circle of the rotary device is configured to match with the inner circular wall of the hollow space of the brush head, and the outer circle of the rotary device is set to match the inner circular wall of the hollow space of the brush head, therefore allowing the rotary device to rotate within the hollow space thereby creating a circular rotation of the tuft of the bristles upon moving the brush handle; and an overhang which is formed around the top edge of the hollow space of the brush head.

9. The manual rotary brush according to claim 8, further including the rotary device having a plurality of circular rotating rings that each of the rings is rotated independently from other rings.

10. The manual rotary brush according to claim 8 wherein matching means is a convex form of the outer circle the rotary device matches with a concave form of the inner circular wall of the hollow space of the brush head.

11. The manual rotary brush according to claim 8 wherein the matching means are tracks configuration of the outer circle of the rotary device matches with grooves configuration of the inner circular wall of the hollow space, and the grooves configuration of the outer circle of the rotary device matches with the tracks configuration of the inner circular wall of the hollow space of the brush head.

* * * * *